US010309591B2

(12) United States Patent
Lan

(10) Patent No.: US 10,309,591 B2
(45) Date of Patent: Jun. 4, 2019

(54) LED LIGHT AND LED STRING LIGHT THEREOF

(71) Applicant: Shenzhen Guanke Technologies Co., Ltd., Shenzhen (CN)

(72) Inventor: Qing Lan, Shenzhen (CN)

(73) Assignee: SHENZHEN GUANKE TECHNOLOGIES CO., LTD., Shenzhen (CN)

( * ) Notice: Subject to any disclaimer, the term of this patent is extended or adjusted under 35 U.S.C. 154(b) by 0 days.

(21) Appl. No.: 15/703,976

(22) Filed: Sep. 13, 2017

(65) Prior Publication Data

US 2019/0063697 A1 Feb. 28, 2019

(30) Foreign Application Priority Data

Aug. 31, 2017 (CN) ..... 2017 1 0772025

(51) Int. Cl.

| | |
|---|---|
| ***F21S 4/00*** | (2016.01) |
| ***F21V 21/00*** | (2006.01) |
| ***F21S 4/10*** | (2016.01) |
| ***F21V 23/00*** | (2015.01) |
| ***F21S 2/00*** | (2016.01) |
| ***F21V 15/01*** | (2006.01) |

(52) U.S. Cl.

CPC ..... *F21S 4/10* (2016.01); *F21S 2/005* (2013.01); *F21V 15/01* (2013.01); *F21V 23/001* (2013.01)

(58) Field of Classification Search

CPC ..... F21V 5/04; F21V 17/12; F21V 17/164; F21V 29/83; F21V 15/01; F21V 23/001; F21S 8/063; F21S 8/046; F21S 4/10; F21S 2/005

See application file for complete search history.

(56) References Cited

U.S. PATENT DOCUMENTS

| | | | | |
|---|---|---|---|---|
| 7,270,468 | B2 * | 9/2007 | Lin | F21V 19/0005 362/249.01 |
| 2013/0335961 | A1 * | 12/2013 | Huang | F21V 13/12 362/235 |
| 2014/0268803 | A1 * | 9/2014 | Keng | F21V 5/04 362/294 |
| 2014/0347846 | A1 * | 11/2014 | Ahn | F21S 8/036 362/147 |
| 2017/0045214 | A1 * | 2/2017 | Johnson | F21V 3/061 |

* cited by examiner

*Primary Examiner* — Thien T Mai

(57) ABSTRACT

A string LED light including a plurality of LED lights connected to each other by wires which includes a holder, a case, a heat sink received in the case, an LED driver electrically connected to the holder and received in the heat sink, a lampshade and a shell. The holder includes a rib and the case includes a supporting portion and a sliding groove alternatively connected with the supporting portion. The rib slides into the supporting portion from the sliding groove to abut against the supporting portion so that the holder is positioned on the case. The shell passes through the lampshade and the case to connect the shell, the lampshade and the case together. Comparing to a conventional fragile incandescent lamp, an integral configuration without assembly or disassembly and time and effort saving are obtained, the shell protects the lampshade from being crash, and the heat sink improves heat dissipation effects.

13 Claims, 2 Drawing Sheets

LED LIGHT AND LED STRING LIGHT THEREOF

BACKGROUND

1. Technical Field

The present disclosure generally relates to light sources field, and especially relates to a Light-Emitting Diode (LED) light and a Light-Emitting Diode (LED) string light thereof.

2. Description of Related Art

In general, a typical string lamp includes a plurality of holders serially connected to each other and a plurality of corresponding bulbs. The bulb is easy to break or crash without any protective configuration, thereby the typical holder and the bulb may be disassembly to carry during no use, but not be carried as an integrated configuration. The plurality of bulbs is respectively needed to be installed in their corresponding holders before the conventional string lamp is used. After it is used, the plurality of bulbs is respectively removed from their corresponding holders to left alone, thereby time and effort is wasted. With the configuration of the above conventional string lamp, after the string lamp is used, the surface temperature of the bulb is very high and easy to burn the hand, thus causing the safety hazard. Therefore, it is needed to design a new string lamp to solve the above problems.

SUMMARY

The disclosure relates to an LED light and an LED string light with a plurality of LED lights serially connected thereof which may have an integral configuration without needing assembly or disassembly and time and effort saving, and not only improve heat dissipation effects and the lifespan of the LED light, but also have high luminous efficiency and energy saving and environmental protection.

In one aspect, an LED light includes: a holder, a case, a heat sink received in the case, an LED driver electrically connected to the holder and received in the heat sink, a lampshade and a shell. The holder includes a rib and the case includes a supporting portion and a sliding groove alternatively connected with the supporting portion. The rib slides into the supporting portion from the sliding groove to abut against the supporting portion so that the holder is positioned on the case. The shell passes through the lampshade and the case to connect the shell, the lampshade and the case together.

Wherein the LED light further includes a body received in the case, the body includes a baseboard connected to an end of the heat sink, and a plurality of LEDs positioned on the baseboard.

Wherein the LED light further includes a wire passing through the LED driver and the heat sink to electrically connect to the LED driver, one end of the wire is connected to the holder and the other end of the wire is connected to the baseboard.

Wherein the case includes a first fixing portion and a first recess connected to the first fixing portion, the lampshade includes a second fixing portion so that the shell passes through the second fixing portion and the first fixing portion in turn; the cross-section of the first fixing portion is ellipsoidal configuration and the cross-section of the second fixing portion is semicircular configuration.

Wherein the plurality of LEDs is arranged, in an orderly manner, on a side of the baseboard away from the heat sink, the light emitted from the LEDs is filled with the lampshade and the lampshade is a PC transparent material.

Wherein the shell is a frame structure and includes a plurality of first supporting members and a plurality of second supporting members perpendicularly connected to the first supporting members, the plurality of second supporting members is arranged parallel to each other, both the first and second supporting members are inside hollow stainless steel bars.

Wherein the first supporting member passes through the second fixing portion and the first fixing portion in turn.

Wherein the heat sink includes a plurality of first cooling chambers and a plurality of second cooling chambers alternatively connected with the plurality of first cooling chambers, both the first and second cooling chambers are sealed to each other along a horizontal direction, and among the plurality of first cooling chambers and the plurality of second chambers, a circular receiving room is formed to receive the LED driver therein.

Wherein the first cooling chamber includes a second recess corresponding to the first recess, the first cooling chamber and the second cooling chamber respectively includes a plurality of cooling fins.

In another aspect, an LED string light according to an exemplary embodiment of the present disclosure includes a plurality of LED lights serially connected to each other, each LED light includes a holder, a case, a heat sink received in the case, an LED driver electrically connected to the holder and received in the heat sink, a lampshade connected with the bottom of the case, and a shell. The holder includes a rib formed on the bottom thereof, and the case includes a supporting portion and a sliding groove alternatively connected with the supporting portion. The rib slides into the supporting portion from the sliding groove to abut against the supporting portion so that the holder is positioned on the case. The shell passes through the lampshade and the case to connect the shell, the lampshade and the case together.

Wherein the LED light further includes a body received in the case and a wire passing through the LED driver and the heat sink to electrically connect to the LED driver, the body includes a baseboard connected to an end of the heat sink, and a plurality of LEDs positioned on the baseboard; one end of the wire is connected to the holder and the other end of the wire is connected to the baseboard.

Wherein the case includes a first fixing portion and a first recess connected to the first fixing portion, the lampshade includes a second fixing portion so that the shell passes through the second fixing portion and the first fixing portion in turn; the cross-section of the first fixing portion is ellipsoidal configuration and the cross-section of the second fixing portion is semicircular configuration.

Wherein the plurality of LEDs is arranged, in an orderly manner, on a side of the baseboard away from the heat sink, the light emitted from the LEDs is filled with the lampshade and the lampshade is a PC transparent material; the baseboard includes a plurality of through-holes, some part of the heat generated by the LEDs is emitted from the lampshade, the other part of the heat is imported into the heat sink from the plurality of through-holes.

Wherein the shell is a frame structure and includes a plurality of first supporting members and a plurality of second supporting members perpendicularly connected to the first supporting members, the plurality of second supporting members is arranged parallel to each other, both the first and second supporting members are inside hollow stainless steel bars.

Wherein the heat sink includes a plurality of first cooling chambers and a plurality of second cooling chambers alternatively connected with the plurality of first cooling chambers, both the first and second cooling chambers are sealed to each other along a horizontal direction, and among the plurality of first cooling chambers and the plurality of second chambers, a circular receiving room is formed to receive the LED driver therein; the first cooling chamber includes a second recess corresponding to the first recess, the first cooling chamber and the second cooling chamber respectively includes a plurality of cooling fins.

The present disclosure provides the advantages as below.

The sliding groove alternatively connects with the supporting portion. The rib slides into the supporting portion from the sliding groove to abut against the supporting portion so that the holder is positioned on the case, thereby a reliable connection between the holder and the case is obtained. Meanwhile, the shell protect the lampshade from being crash, thereby an integral configuration without needing assembly or disassembly and time and effort saving are obtained. The heat sink and the shell are provided to not only improve heat dissipation effects and the lifespan of the LED light, but also have the characteristics of high luminous efficiency and energy saving and environmental protection.

DETAILED DESCRIPTION

Figure 1:
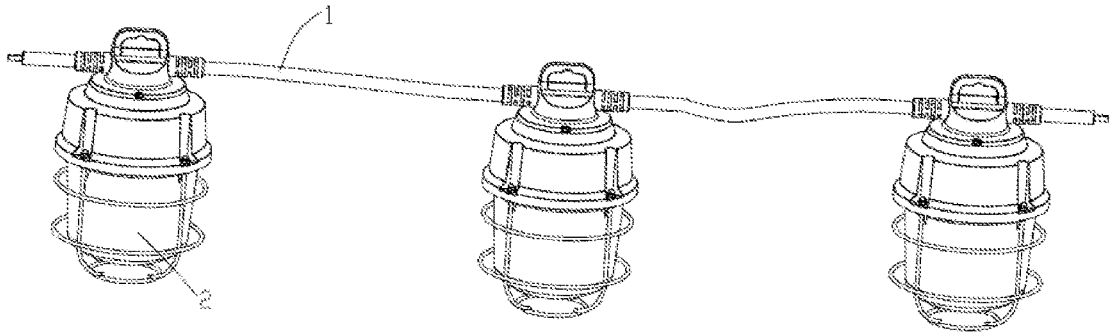
FIG. 1 is a schematic view of the LED string light in accordance with an exemplary embodiment.

The disclosure is illustrated by way of example and not by way of limitation in the figures of the accompanying drawings, in which like reference numerals indicate similar elements.

Referring to FIG. 1, the LED string light according to an exemplary embodiment includes a plurality of LED lights 2 serially connected to each other by wires.

In an exemplary embodiment of the present disclosure, the LED light 2 defines a plastic layer (not labeled) on two ends which are connected to the wire 1. The plastic layer is used to protect the connecting point of the LED light 2 and the wire 1.

Figure 2:
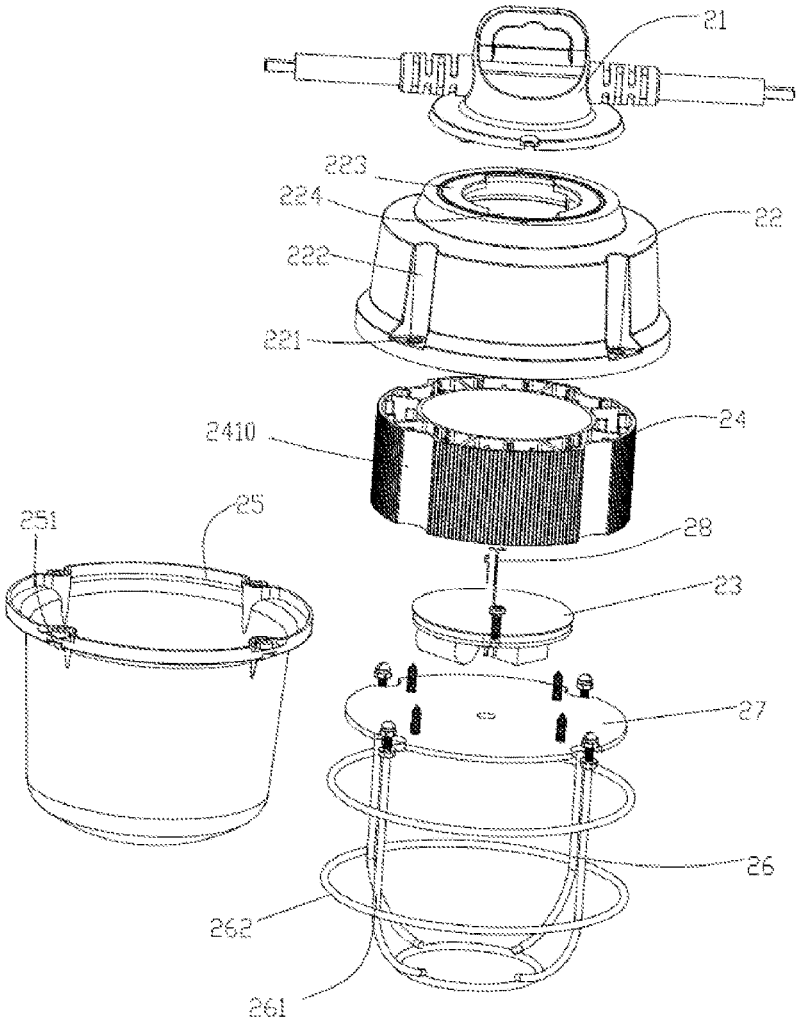
FIG. 2 is an exploded schematic view of the LED light of FIG. 1.
Figure 4:
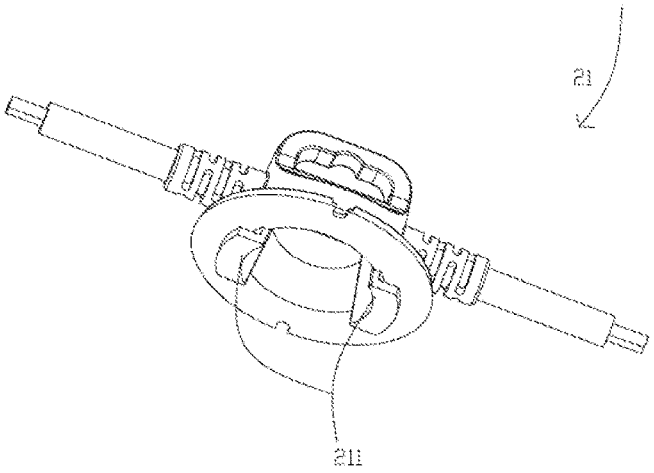
FIG. 4 is a schematic view of a holder of the LED light of FIG. 2 from another side.

Furthermore, referring to FIG. 2 and FIG. 4, the LED light 2 includes a holder 21, a case 22, an LED driver 23, a heat sink 24, a lampshade 25 and a shell 26. The LED driver 23 is electrically connected to the holder 21 and received in the heat sink 24. The case 22 is received in the heat sink 24. The holder 21 includes a rib 211 formed on the bottom thereof, and the case 22 includes a supporting portion 223 and a sliding groove 224 alternatively connected with the supporting portion 223. The rib 211 slides into the supporting portion 223 from the sliding groove 224 to abut against the supporting portion 223 so that the holder 21 is positioned on the case 22. The shell 26 passes through the lampshade 25 and the case 22 to connect the shell 26, the lampshade 25 and the case 22 together.

In an exemplary embodiment of the present disclosure, the LED string light includes a plurality of LED lights 2 serially connected to each other by wires, thereby an integral configuration without assembly or disassembly and time and effort saving are obtained. Each LED light 2 includes the shell 26 protecting the lampshade 25, comparing to a conventional fragile incandescent lamp, the shell 26 may protect the lampshade 25 from being crash. The heat sink 24 and the shell 26 are provided to not only improve heat dissipation effects and the lifespan of the LED light, but also have the characteristics of high luminous efficiency and energy saving and environmental protection.

In an exemplary embodiment of the present disclosure, The holder 21 includes the rib 211, the case 22 includes the supporting portion 223 and the sliding groove 224 alternatively connected with the supporting portion 223. The rib 211 slides into the supporting portion 223 from the sliding groove 224 to abut against the supporting portion 223 so that the holder 21 is reliably positioned on the case 22. The holder 21 and the case 22 respectively includes a screw mounting portion (not labeled). When the rib 211 slides into the supporting portion 223 from the sliding groove 224 to abut against the supporting portion 223 to reliably position the holder 21 on the case 22, the screw mounting portion of the holder 21 is coincided with the screw mounting portion of the case 22. At this time, the screw is inserted to lock with the screw mounting portions of the holder 21 and the case 22, thereby the connection force between the holder 21 and the case 22 is further enhanced. The LED driver 23, the heat sink 24, the lampshade 25 and the shell 26 all are assembled with the case 22, so that the self-weights of the LED driver 23, the heat sink 24, the lampshade 25 and the shell 26 all are undertook by the case 22. Therefore, the connection force requirement between the holder 21 and the case 22 is very high in order to avoid the lack of connection force between the holder 21 and the case 22, resulting in the disjointed fall between the holder 21 and the case 22 during use of the LED light 2, which may cause the safety hazard and affect the lifespan of the LED light 2.

In an exemplary embodiment of the present disclosure, the LED driver 23 includes a plurality of circuit units (not shown) to form a driving circuit (not shown). The driving circuit is provided to control lighting and extinguishing the LED light 2. The LED driver 23 is received in the heat sink 24 for dissipating the heat from the LED driver 23, thereby avoid the LED driver 23 fail to work and affect the lifespan of the LED light 2 due to the heat caused by the LED driver 23 itself too high.

In an exemplary embodiment of the present disclosure, the holder 21 further includes an inner hollow buckle (not labeled) for installing the LED string light to external devices (not shown). The buckle includes a sliding slot for sliding a hanging rope therein to unfold the LED string light.

Figure 5:
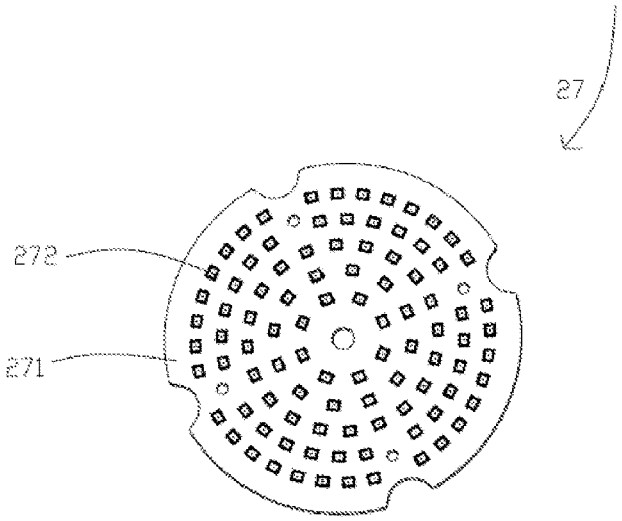
FIG. 5 is a schematic view of a body of the LED light of FIG. 2.

Furthermore, referring to FIG. 5, the LED light 2 also includes a body 27 received in the lampshade 25. The body 27 includes a baseboard 271 connected to an end of the heat sink 24, and a plurality of LEDs 272 positioned on the baseboard 271.

In an exemplary embodiment of the present disclosure, the plurality of LEDs 272 is arranged, in an orderly manner, on a side of the baseboard 271 away from the heat sink 24. The light emitted from the LEDs 272 is filled with the lampshade 25 and the lampshade 25 is a PC transparent material. The baseboard 271 includes a plurality of through-holes (not shown), some part of the heat generated by the LEDs 272 is emitted from the lampshade 25, the other part of the heat is imported into the heat sink 24 from the plurality of through-holes.

Furthermore, the LED light 2 also includes a wire 28 passing through the LED driver 23 and the heat sink 24 to electrically connect to the LED driver 23. One end of the wire 28 is connected to the holder 21 and the other end of the wire 28 is connected to the baseboard 271.

In an exemplary embodiment of the present disclosure, the electrical connection between the holder 21, the body 27 and the LED driver 23 is realized by the wire 28.

Furthermore, the case 22 includes a plurality of first fixing portions 221 and a first recess 222 connected to the plurality of first fixing portions 221. The lampshade 25 includes a plurality of second fixing portions 251 so that the shell 26 passing through the second fixing portion 251 and the first fixing portion 221 in turn. The cross-section of the first fixing portion 221 is ellipsoidal configuration and the cross-section of the second fixing portion 251 is semicircular configuration.

In an exemplary embodiment of the present disclosure, the shell 26 is a frame structure and includes a plurality of first supporting members 261 and a plurality of second supporting members 262 perpendicularly connected to the first supporting members 261. The first supporting member 261 passes through the second fixing portion 251 and the first fixing portion 221 in turn. The plurality of second supporting members 262 is arranged parallel to each other. Both the first and second supporting members 261, 262 are inside hollow stainless steel bars to improve the breathability of the shell 26.

In an exemplary embodiment of the present disclosure, the LED light further includes a first fixing member and a second fixing member. After the first supporting member 261 passes through the second fixing portion 251 and the first fixing portion 221 in turn, the first fixing member is mounted on the first fixing portion 221 and fixed on an end of the first supporting member 261, the second fixing member is mounted on the second fixing portion 251 and fixed on an opposite end of the first supporting member 261. The first recess 222 connects with the first fixing portion 221 so that the first fixing member may be rapidly mounted on the fixing portion 221.

In an exemplary embodiment of the present disclosure, preferably, the first supporting member 261 includes threads, the first fixing member is a cap nut and the second fixing member is an ordinary nut. The first fixing member and the second fixing member are threadedly fastened on the first supporting member 261 so that the shell 26, the lampshade 25 and the case 22 may tightly fixed together.

Figure 3:
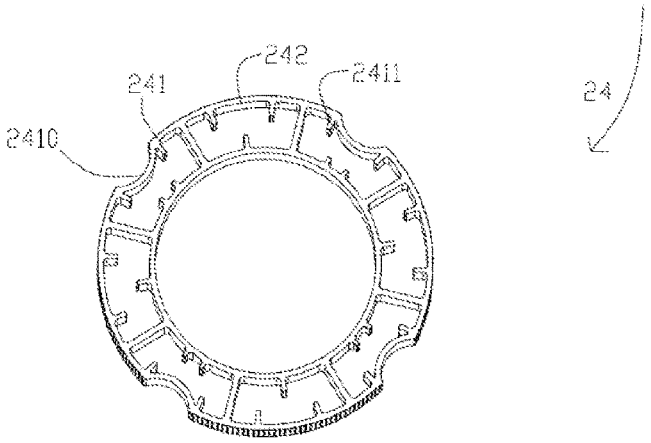
FIG. 3 is a schematic view of a heat sink of the LED light of FIG. 2.

Furthermore, referring to FIG. 3, the heat sink 24 includes a plurality of first cooling chambers 241 and a plurality of second cooling chambers 242 alternatively connected with the plurality of first cooling chambers 241. Among the plurality of first cooling chambers 241 and the plurality of second chambers 242, a circular receiving room (not labeled) is formed to receive the LED driver 23 therein.

In an exemplary embodiment of the present disclosure, both the first and second cooling chambers 241, 242 are sealed to each other along a horizontal direction so that the first cooling chamber 241 and the second cooling chamber 242 may ventilate up and down, which is conducive to heat conduction and improve heat dissipation. The first cooling chamber 241 includes a second recess 2410 corresponding to the first recess 222, the first cooling chamber 241 and the second cooling chamber 242 respectively includes a plurality of cooling fins 2411.

In an exemplary embodiment of the present disclosure, the first cooling chamber 241 includes the second recess 2410 corresponding to the first recess 222, the first cooling chamber 241 and the second cooling chamber 242 respectively includes the plurality of cooling fins 2411, thereby the assembly of the heat sink 24 and the case 22 is more rapid and the area of the heat dissipation is increased to improve the heat dissipation efficiency of the heat sink 24.

Although the features and elements of the present disclosure are described as embodiments in particular combinations, each feature or element can be used alone or in other various combinations within the principles of the present disclosure to the full extent indicated by the broad general meaning of the terms in which the appended claims are expressed.

What is claimed is:

1. An LED light comprising:

a holder comprising a rib formed on the bottom thereof;

a case comprising a supporting portion and a sliding groove alternatively connected with the supporting portion;

a heat sink received in the case;

an LED driver electrically connected to the holder and received in the heat sink;

a lampshade connected with the bottom of the case;

a shell passing through the lampshade and the case to connect the shell, the case and the lampshade together; wherein the rib slides into the supporting portion from the sliding groove to abut against the supporting portion so that the holder is positioned on the case, wherein the case comprises a first fixing portion and a first recess connected to the first fixing portion, the lampshade comprises a second fixing portion so that the shell passing through the second fixing portion and the first fixing portion in turn; the cross-section of the first fixing portion is ellipsoidal configuration and the cross-section of the second fixing portion is semicircular configuration.

2. The LED light as claimed in claim 1, wherein the LED light further comprises a body received in the case, the body comprises a baseboard connected to an end of the heat sink, and a plurality of LEDs positioned on the baseboard.

3. The LED light as claimed in claim 2, wherein the LED light further comprises a wire passing through the LED driver and the heat sink to electrically connect to the LED driver, one end of the wire is connected to the holder and the other end of the wire is connected to the baseboard.

4. The LED light as claimed in claim 2, wherein the plurality of LEDs is arranged, in an orderly manner, on a side of the baseboard away from the heat sink, the light emitted from the LEDs is filled with the lampshade and the lampshade is a PC transparent material.

5. The LED light as claimed in claim 1, wherein the shell is a frame structure and comprises a plurality of first supporting members and a plurality of second supporting members perpendicularly connected to the first supporting members, the plurality of second supporting members is arranged parallel to each other, both the first and second supporting members are inside hollow stainless steel bars.

6. The LED light as claimed in claim 5, wherein the first supporting member passes through the second fixing portion and the first fixing portion in turn.

7. The LED light as claimed in claim 1, wherein the heat sink comprises a plurality of first cooling chambers and a plurality of second cooling chambers alternatively connected with the plurality of first cooling chambers, both the first and second cooling chambers are sealed to each other along a horizontal direction, and among the plurality of first cooling chambers and the plurality of second chambers, a circular receiving room is formed to receive the LED driver therein.

8. The LED light as claimed in claim 7, wherein the first cooling chamber comprises a second recess corresponding to the first recess, the first cooling chamber and the second cooling chamber respectively comprises a plurality of cooling fins.

9. An LED string light comprising a plurality of LED lights serially connected to each other, each LED light comprising:

a holder comprising a rib formed on the bottom thereof;

a case comprising a supporting portion and a sliding groove alternatively connected with the supporting portion;

a heat sink received in the case;

an LED driver electrically connected to the holder and received in the heat sink;

a lampshade connected with the bottom of the case;

a shell passing through the lampshade and the case to connect the shell, the case and the lampshade together; wherein the rib slides into the supporting portion from the sliding groove to abut against the supporting portion so that the holder is positioned on the case, wherein the case comprises a first fixing portion and a first recess connected to the first fixing portion, the lampshade comprises a second fixing portion so that the shell passing through the second fixing portion and the first fixing portion in turn; the cross-section of the first fixing portion is ellipsoidal configuration and the cross-section of the second fixing portion is semicircular configuration.

10. The LED string light as claimed in claim 9, wherein the LED light further comprises a body received in the case and a wire passing through the LED driver and the heat sink to electrically connect to the LED driver, the body comprises a baseboard connected to an end of the heat sink, and a plurality of LEDs positioned on the baseboard; one end of the wire is connected to the holder and the other end of the wire is connected to the baseboard.

11. The LED string light as claimed in claim 10, wherein the plurality of LEDs is arranged, in an orderly manner, on a side of the baseboard away from the heat sink, the light emitted from the LEDs is filled with the lampshade and the lampshade is a PC transparent material; the baseboard comprises a plurality of through-holes, some part of the heat generated by the LEDs is emitted from the lampshade, the other part of the heat is imported into the heat sink from the plurality of through-holes.

12. The LED string light as claimed in claim 9, wherein the shell is a frame structure and comprises a plurality of first supporting members and a plurality of second supporting members perpendicularly connected to the first supporting members, the plurality of second supporting members is arranged parallel to each other, both the first and second supporting members are inside hollow stainless steel bars.

13. The LED string light as claimed in claim 9, wherein the heat sink comprises a plurality of first cooling chambers and a plurality of second cooling chambers alternatively connected with the plurality of first cooling chambers, both the first and second cooling chambers are sealed to each other along a horizontal direction, and among the plurality of first cooling chambers and the plurality of second chambers, a circular receiving room is formed to receive the LED driver therein; the first cooling chamber comprises a second recess corresponding to the first recess, the first cooling chamber and the second cooling chamber respectively comprises a plurality of cooling fins.

* * * * *